United States Patent [19]

Michelson

[11] 4,324,426

[45] Apr. 13, 1982

[54] LOCK-PROTECTING HASP

[75] Inventor: Thorwald J. Michelson, Excelsior, Minn.

[73] Assignee: Transportation Security, Inc., Eden Prarie, Minn.

[21] Appl. No.: 128,524

[22] Filed: Mar. 10, 1980

[51] Int. Cl.[3] ..... E05C 19/08

[52] U.S. Cl. ..... 292/281

[58] Field of Search ..... 292/218, 1, 302, 288, 292/258, 300; 70/56, 68

[56] References Cited

U.S. PATENT DOCUMENTS

| | | | |
|---|---|---|---|
| 3,460,861 | 8/1969 | Niilola | 292/281 |
| 3,736,016 | 5/1973 | Garvey et al. | 70/56 X |
| 3,784,243 | 1/1974 | Postva, Jr. | 292/218 |
| 4,106,315 | 8/1978 | Dohonyos | 70/56 |

*Primary Examiner*—Richard E. Moore

*Attorney, Agent, or Firm*—Hugh D. Jaeger

[57] ABSTRACT

Lock-protecting hasp which secures to at least one door and a member or to two doors and a subsequent shackle lock whether the lock be key or combination and protects the shackle from being cut or pried off the body of the lock or between the shackle, the body and the lock-protecting hasp. The lock-protecting hasp includes two outside mount hasps, a spacer secured to each of the outside mount hasps, and a protector block engaged to each of the outside mount hasps. The lock-protecting hasp particularly lends itself to use on semi-trailers. The lock-protecting hasp accepts any lock of suitable size.

14 Claims, 4 Drawing Figures

LOCK-PROTECTING HASP

BACKGROUND OF THE INVENTION

1. Field of the Invention

The present invention pertains to locking members and, more particularly, pertains to a lock-protecting hasp including two mounting hasps and a shackle lock.

2. Description of the Prior Art

There has been a long-felt need for a hasp which will protect shackle locks, especially protecting the locks from bolt cutters or pry bars. There has been a special need for suitable hasps on semi-trailers.

Prior art semi-trailers have used shackle locks which have been easy to remove by cutting the shackle with a bolt cutter or inserting a pry bar into the shackle which is engaged in a lock on a semi-tractor/trailer and prying the lock away from the hasp on the semi-tractor/trailer. While some have tried to use stronger case hasp and locks, this has not solved the problem. Some companies do not even use locks but just use a stranded wire with a lead seal hoping that the wire/seal arrangement will deter breakins, but such is not often the case.

The prior art door handles which swing 180° to lock the door in position and then drop down 90° to engage against a hasp for subsequently accepting a shackle block have provided easy access of removing the shackle lock with either bolt cutters or pry bar. This is especially so because the lock is exposed in open view to an individual who desires either to cut the shackle or pry the shackle with respect to the body of the lock.

The present invention overcomes the disadvantages of prior art by providing a lock-protecting hasp which fully encloses and protects not only the shackle of the lock with respect to the lock body but also provides outside mounting hasp encompassing the shackle in the body of the lock preventing cutting or prying of the shackle or of the body of the lock.

SUMMARY OF THE INVENTION

The general purpose of the present invention is to provide a lock-protecting hasp for encompassing the shackle and body of the lock-protecting hasp for use on at least one door member or on two doors such as the doors of a semi-trailer. The lock-protecting hasp is easy to use such as by a tractor/trailer driver or any other individual and requires no manual dexterity or skill to lock the lock into position on the doors.

According to one embodiment of the present invention, there is provided a lock-protecting hasp including identical and opposing outside mounting hasps of an L-shaped structure where the bend of the L is slightly angular with respect to the surface, two elongated opposing holes in the leg of the L for accepting a shackle of a lock and including outer radial circumferences on the elongated holes providing for rotation of the shackle of the lock, a spacer secured to each top surface of the leg of the L member including elongated opposing holes of a slightly larger height and width and including a slightly larger radial outer circumference, and a protector block secured to the outer edge of the spacer and disposed along the longitudinal length slightly above the elongated holes of the spacer and leg of the L member, a plurality of bolt holes in the upper portion of the L member, and a corresponding back plate having a plurality of holes corresponding and in alignment to those holes in the L member whereby the outside mounting hasp is bolted to doors or a door and a member with at least three bolts providing for secure engagement to the door and respective member, and a shackle lock which engages through opposing align holes in one end of the legs and respective spacers and through opposing align holes at the other end of the leg and the respective spacer and being engaged into a locking position thereby securing the shackle through the respective holes in substantially close relationship between the spacer leg and spacer and the protector blocks covering any area of freedom between the shackle lock body and the respective spacers and legs preventing any exposed portions of the shackle or lock body for prying by pry bar or cutting by bolt cutter. The backing plate can have lips to accept a U-shaped channel not only to protect the nuts of the bolts from damaging any adjacent objects but also providing for further security.

A significant aspect and feature of the present invention is a lock-protecting hasp which protects the shackle of the lock. The lock-protecting hasp takes up any extra slack with the spacer member and protector block on each of the mounting hasps. The lock-protecting hasp accepts any shackle lock and is especially intended for use with case-hardened locks such as the Abeloy lock made in Finland. The lock-protecting hasp utilizes a minimum of from three to five bolts preventing anyone's removing the hardware.

Another significant aspect of the present invention is a lock-protecting hasp which would take a considerable period of time, much longer than three minutes, to gain access to the lock-protecting hasp. The only foreseeable way of removing the lock-protecting hasp would be with a cutting torch which would not only take a considerable period of time and require heavy equipment such as acetylene tanks, but would also attract a considerable amount of attention, especially when sparks would be flying, whether it would be day or night, during the cutting process.

Another significant aspect of the present invention is a lock-protecting hasp which provides absolute security and keeps doors locked especially doors of a semi-trailer, preventing theft of loads in the semi-trailer.

A further significant aspect of the present invention is a lock-protecting hasp which can utilize any size bolts and accept any size lock. The lock-protecting hasp protects a shackle and provides substantially little or no space to insert any tools such as a bolt cutter, pry bar, or any type of saw in an attempt to remove the lock.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference numerals designate like parts throughout the figures thereof, and wherein.

DESCRIPTION OF PREFERRED EMBODIMENTS

Figure 1:
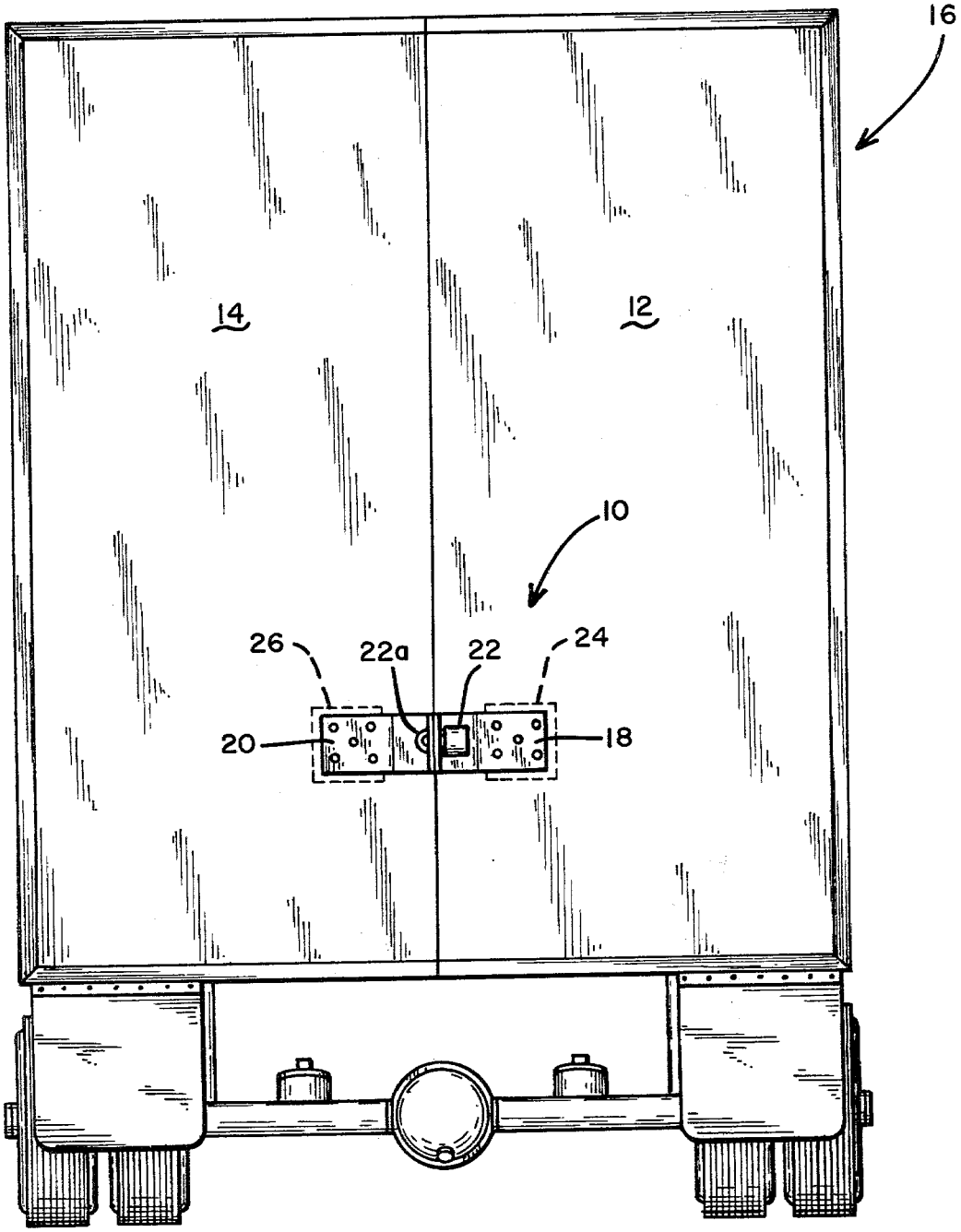
FIG. 1 illustrates a rear view of a semi-tractor/trailer having a lock-protecting hasp mounted on the two opposing doors of the semi-tractor/trailer.

FIG. 1, which illustrates an end view of a lock-protecting hasp, the present invention, shows the lock-protecting hasp 10, secured to opposing right door 12 and left door 14 of a semi-trailer 16. The lock-protecting hasp includes a right outside mounting hasp 18, a left opposing aligned outside mounting hasp 20, and a lock 22 including a shackle 22*a* secured between the right and left outside hasps 18 and 20. The outside mounting hasps also include a spacer and protector block, as later described in detail. A plurality of bolts secure the outside mounting hasps 18 and 20 to the doors 12 and 14 respectively with a plurality of round-headed square-shanked carriage bolts and can also use inside mounting support plates 24 and 26 respectively.

Figure 2:
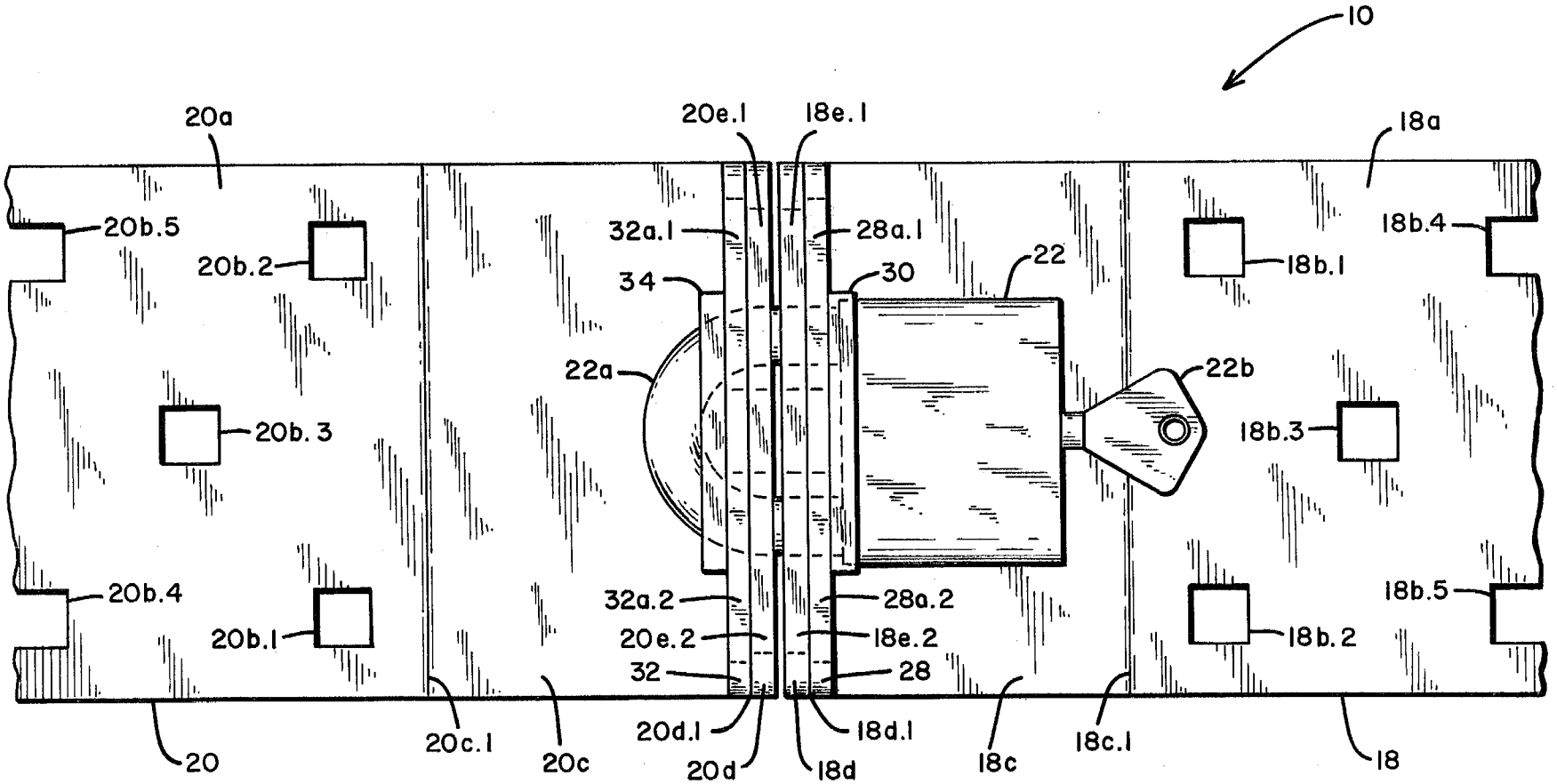
FIG. 2 illustrates an enlarged top view of the lock-protecting hasp, partially cut away on the ends.
Figure 4:
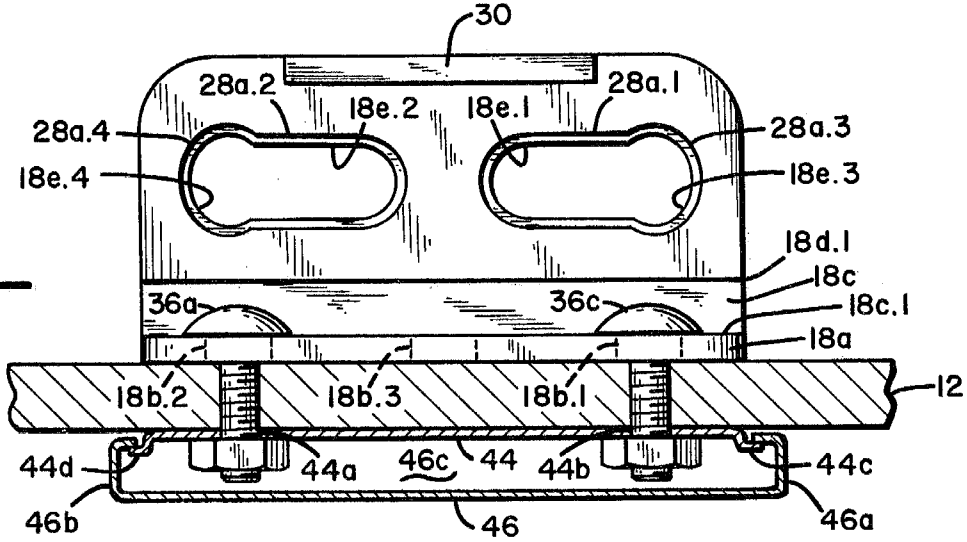

FIG. 2 shows an enlarged top view of the lock-protecting hasp 10 with the ends partially cut away. The right outside mounting hasp 18 includes a flat longitudinal member 18*a* having a plurality of holes 18*b*.1 through 18*b*.5 disposed in a triangular relationship with respect to each other. Angular member 18*c* with respect to the flat member 18*a* extends at a crease line 18*c*.1 to a point of the leg 18*d* at the line 18*d*.1. The leg includes two elongated shackle holes 18*e*.1 and 18*e*.2, as later described in detail, positioned in the leg on the same axial line with respect to each other. The right outside mounting member 18 can be made of 3/16" steel or other like material. A longitudinal rectangular spacer 28 secures to the leg 18*d* such as by welding and includes two elongated opposing aligned holes 28*a*.1 and 28*a*.2 of slightly larger size than the holes 18*e*.1 and 18*e*.2 to facilitate locating the forward end of the shackle 22*a* of the lock 22. The spacer 28 is made of like material as is the outside mounting hasp, such as 3/16" steel. A protector block 30 secures to the spacer 28. The very top of the spacer is illustrated in FIG. 4 and can be made out of ¼" bar stock and welded to the spacer. Left outside mounting hasp 20 includes identical structural elements including longitudinal member 20*a*, holes 20*b*.1 through 20*b*.5, angular member 20*c* at crease line 20*c*.1, leg 20*d* at crease line 20*d*.1, longitudinal holes 28.1 and 28.2, spacer 32 including elongated holes 32*a*.1 and 32*a*.2 and protector 34.

Figure 3:
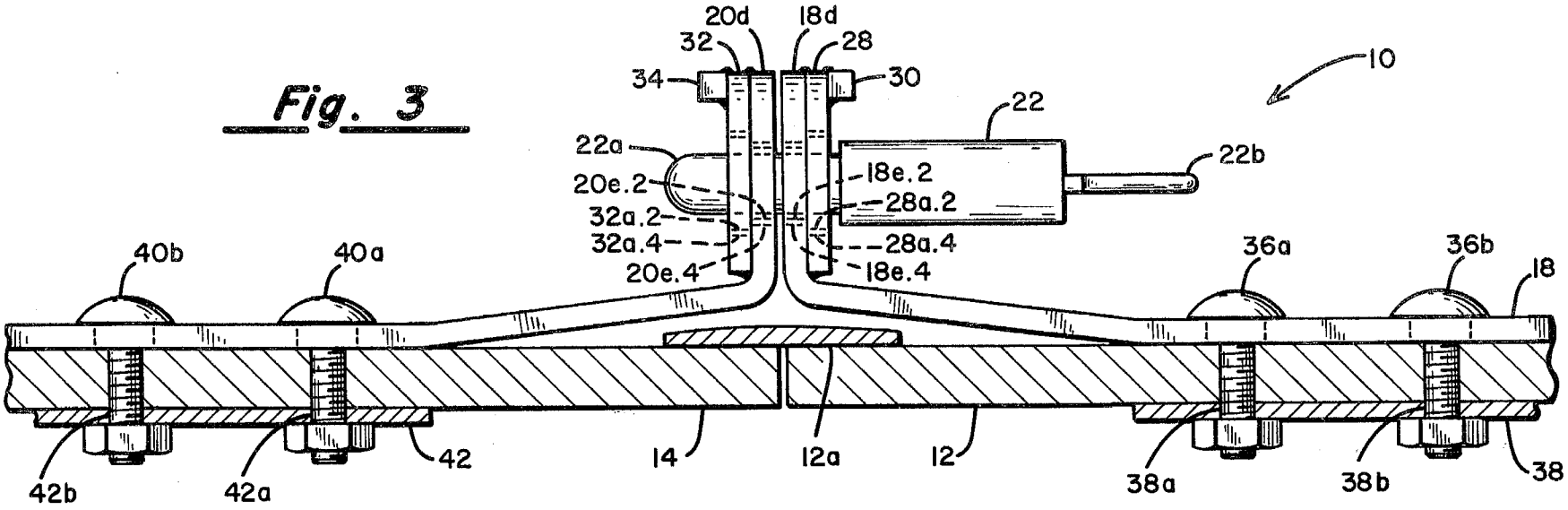
FIG. 3 illustrates a side view of the lock-protecting hasp, partially cut away on the ends; and, FIG. 4 illustrates an end view of the lock-protecting hasp.

FIG. 3, which illustrates a side view of the lock-protecting hasp 10 mounted to right door 12 and left door 14 shows right outside mounting hasp 18 bolted to right door 12 with a plurality of round-headed carriage bolts 36.*a* and 36.*b* which extend through the right door 12 through an inside mounting support plate 38 having corresponding holes 38.*a* and 38.*b*. Right door 12 can include an overlapping strip 12*a* to insulate the outside climate conditions from the inside of the trailer. All other numerals correspond to those structural elements previously described in FIG. 2.

FIG. 4 illustrates an end view of the right outside mounting hasp member 18 and associated structure including the trailer door 12, round-headed carriage bolts 36 in another embodiment of an inside mounting support plate 44 including bolt holes 44*a* and 44*b* and lips 44*c* and 44*d*. A channel 46 including corresponding lips 46*a* and 46*b* slide over lips 44*c* and 44*d* respectively. Channel 46 can include an end member 46*c* which abuts up to the end of the mounting plate and also include an opposing scored end—not illustrated in FIG. 4 for purposes of clarity in the drawing—which can be hammered down to close and encompass the other end of the channel as described. It is to be noted that the elongated holes 18*e*.1 and 18*e*.2 have radial outer circumferential edges 18*e*.3 and 18*e*.4 to allow for rotation of the shackle within the elongated holes 18*e*.1 and 18*e*.2. The elongated holes 28*a*.1 and 28*a*.2 of the spacer include outer radial circumferential holes 28*a*.3 and 28*a*.4 respectively to allow for rotation of the shackle 22*a* of the lock 22 likewise. The oversize of the holes 28 with respect to 18 is to allow for finding and placement of the end of the shackle into the holes 18 and 28 and respectively through the holes 20 and 32 in the opposing leg and spacer. These holes are also illustrated in FIG. 3.

PREFERRED MODE OF OPERATION

The lock-protecting hasp 10 is installed on suitable doors or a door and a stationary member by bolting the outside mounting hasp 18 and 20 utilizing round-headed carriage bolts with appropriate inside mounting support legs as required. The members 18 and 20 are identical physical structure and can be interchanged, two sets of numbers being utilized for purposes of description of the structural element and explanation in mode of operation.

In operation, a lock 20 having an open shackle 22*a* with a key is held in an individual's hand with the lock body 22 held such that the end of shackle 22*a* for a right-handed individual is positioned through hole 18*e*.4, 28*a*.4, 20*e*.4, and 32*a*.4, then the lock body is rotated one-quarter counterclockwise turn, the lock body 22 is then flipped from a downward position towards the individual and upward the right hand and then the lock body is rotated one-quarter turn in a counterclockwise direction having the end of the shackle go through holes in order 32*a*.1, 20*e*.1, 18*e*.1, and 28*a*.1, and then the lock body 22 is rotated towards the individual and in towards the trailer door 180°, at which time the shackle is held with the individual's left hand and lock body 22 is pushed toward the shackle locking the shackle into the lock, at which time the key 22*b* is turned, thereby engaging the locking mechanism and subsequently removed. For a left-handed person, the operation would be reversed, the respective operation taking into account the reversal of the structural elements.

The protector blocks 30 and 34 prevent engagement of a pry bar or a cutter about shackle 22*a* about lock body 22 or in between shackle 22*a* or lock body 22 and any of the structural support of the lock-protecting hasp 10 and accompanying members 18 and 20.

The lock 22 is removed in a likewise manner after being unlocked with a reverse operation of the steps.

Various modifications can be made to the lock-protecting hasp in the present invention without departing from the apparent scope thereof. Each of the outside mounting hasps including the spacer protector block can be cast from steel or other like material and be one continuous member. Depending upon the particular application, the size of the outside mounting hasp and the elongated holes can be varied for different size doors and different size lock bodies. Inherently, the larger the lock and the larger the members, the stronger the lock system.

Having thus described the invention, what is claimed is:

1. A lock-protecting hasp for use on a stationary member and a movable member, the lock-protecting hasp comprising:

opposing aligned outside mounting hasps, each of said mounting hasps including a longitudinal member having a plurality of bolt holes, an angular member connected to the longitudinal member rising upward at a slight angle from said longitudinal member, and a vertical leg connected to said angular member, two elongated holes in said leg for accepting a shackle of a lock, a spacer member on each of said legs of said outside mounting hasp and including two aligned elongated holes for accepting said shackle of said lock, and a protector block affixed to a top of said spacer and running substantially the distance above said elongated holes whereby said shackle connects through each of said aligned holes of said aligned outside mounting hasps and said spacer thereby substantially protecting small space exposed between said shackle and said lock body of said legs of said outside mounting hasps and thereby securing said space between said shackle, said lock body, and said spacer by said protector block.

2. The lock-protecting hasp of claim 1 wherein said elongated holes of said spacer are larger than said elongated holes in said leg providing for positioning of said shackle.

3. The lock-protecting hasp of claim 1 wherein said elongated holes in said leg include an outer radial circumference on each of said holes providing for rotation of said shackle within said leg.

4. The lock-protecting hasp of claim 1 wherein said elongated holes in said spacer include an outer radial circumferential circular edge at each of the outer ends of said elongated holes providing for rotation of said shackle.

5. The lock-protecting hasp of claim 1 wherein said elongated holes are larger in said spacer than in said leg.

6. The lock-protecting hasp of claim 5 wherein said elongated holes in outer circular circumferential edges are larger in said spacer than in said leg.

7. The lock-protecting hasp of claim 1 comprising an inside mounting support plate for each of said outside mounting hasps including a plurality of bolt holes in alignment with said bolt holes in said outside mounting hasps.

8. The lock-protecting hasp of claim 7 wherein said bolts are round-headed square shank carriage bolts.

9. The lock-protecting hasp of claim 7 comprising an inside mounting support plate for each of said outside mounting hasps including a plurality of aligned bolt holes and upward rising lips on each end of said plate and a corresponding panel including corresponding lips for sliding frictional engagement with said inside mounting support plate whereby said corresponding channel slidably and frictionally engages with said lipped inside mounting support plate and covers said nuts and bolts.

10. The lock-protecting hasp of claim 9 wherein said outside channel includes at least one closed end and another scored end whereby said scored end is hammered into position when said outside channel is engaged to said inside mounting support plate.

11. A lock-protecting hasp for trailer doors of a semi-trailer comprising opposing and geometrically identical outside mounting hasps including a longitudinal rectangular member having a plurality of bolt holes, an angular member rising from said longitudinal rectangular member at a slight angle, and a vertical leg connected to said angular member, said vertical leg including two elongated axially aligned holes for accepting the shackle of a lock and including outer circumferential enlarged ends, a spacer secured to said leg having substantially the same size as same leg and including two elongated aligned holes of a slightly larger size than said holes in said leg and including outer radial circumferential edges slightly larger than the corresponding holes in said spacer, a rectangular bar protector block secured to said spacer above said holes and an inside mounting support plate having a longitudinal rectangular size whereby said longitudinal member mounts to said door on the outer side and said inside mount support plate mounts on the inner side with round-headed square-shank carriage bolts securing said members to said doors, and a shackle lock fits into said opposing holes and through the other set of said opposing holes and is locked thereto, thereby securing said hasp members together and said protector block isolates said shackle of said lock body from outside removal means.

12. The lock-protecting hasp of claim 11 wherein said outside mounting hasp is 3/16" steel.

13. The lock-protecting hasp of claim 11 wherein said spacer is $\frac{1}{8}$" steel.

14. The lock-protecting hasp of claim 11 wherein said inside mount support plate is $\frac{1}{8}$" steel.

* * * * *